US007924236B2

(12) United States Patent
Pintos et al.

(10) Patent No.: US 7,924,236 B2
(45) Date of Patent: Apr. 12, 2011

(54) COMPACT PORTABLE ANTENNA FOR TERRESTRIAL DIGITAL TELEVISION

(75) Inventors: Jean-Francois Pintos, Bourgbarre (FR); Philippe Minard, Saint Medard sur Ille (FR); Ali Louzir, Rennes (FR)

(73) Assignee: Thomas Licensing, Boulogne-Billancourt (FR)

( * ) Notice: Subject to any disclaimer, the term of this patent is extended or adjusted under 35 U.S.C. 154(b) by 304 days.

(21) Appl. No.: 12/227,191

(22) PCT Filed: May 4, 2007

(86) PCT No.: PCT/FR2007/051227

§ 371 (c)(1), (2), (4) Date: Nov. 10, 2008

(87) PCT Pub. No.: WO2007/135313

PCT Pub. Date: Nov. 29, 2007

(65) Prior Publication Data

US 2009/0096697 A1 Apr. 16, 2009

(30) Foreign Application Priority Data

May 12, 2006 (FR) ..... 06 04269

(51) Int. Cl.
*H01Q 9/16* (2006.01)
*H01Q 1/24* (2006.01)

(52) U.S. Cl. ..... 343/793; 343/702

(58) Field of Classification Search ..... 343/700 MS, 343/702, 793, 795, 895
See application file for complete search history.

(56) References Cited

U.S. PATENT DOCUMENTS

| | | | | |
|---|---|---|---|---|
| 4,313,119 | A | 1/1982 | Garay et al. | |
| 7,053,843 | B2 * | 5/2006 | Nysen | 343/702 |
| 2002/0013094 | A1 * | 1/2002 | Jones et al. | 439/625 |
| 2004/0164914 | A1 | 8/2004 | Sue | |
| 2005/0035919 | A1 * | 2/2005 | Yang et al. | 343/795 |
| 2010/0207837 | A1 * | 8/2010 | Minard et al. | 343/794 |

FOREIGN PATENT DOCUMENTS

FR 2884973 10/2006

OTHER PUBLICATIONS

Search Report Dated Oct. 29, 2007.

* cited by examiner

*Primary Examiner* — Shih-Chao Chen
(74) *Attorney, Agent, or Firm* — Robert D. Shedd; Jeffrey M. Navon

(57) ABSTRACT

The present invention relates to a portable compact antenna formed from a first dipole type element operating in a first frequency band and comprising a first and at least one second conductive arm, differentially supplied, the first arm or cold arm forming at least one cover for an electronic card and the second arm or hot arm being constituted by a U-shaped conductive element realized on an insulating substrate. Further, a radiating element with bends is realized between the branches of the U-shaped element and is dimensioned to operate in a second frequency band.

10 Claims, 8 Drawing Sheets

| # | X | Y |
|---|---|---|
| 1 | 0.225363 | 0.874412 |
| 2 | 0.173021 | 2.98042 |
| 3 | 0.19483 | 16.4173 |

| # | X | Y |
|---|---|---|
| 1 | 0.174475 | -13.6276 |
| 2 | 0.225363 | -20.13 |
| 3 | 0.19483 | -6.07567 |

| # | X | Y |
|---|---|---|
| 1 | 0.1746 | 1.00677 |
| 2 | 0.225 | 1.21372 |
| 3 | 0.2034 | 10.2628 |

| # | X | Y |
|---|---|---|
| 1 | 0.1746 | -18.291 |
| 2 | 0.225 | -17.2087 |
| 3 | 0.4698 | -1.49912 |
| 4 | 0.8622 | 1.98183 |

COMPACT PORTABLE ANTENNA FOR TERRESTRIAL DIGITAL TELEVISION

This application claims the benefit, under 35 U.S.C. § 365 of International Application PCT/FR2007/051227, filed May 4, 2007, which was published in accordance with PCT Article 21(2) on Nov. 29, 2007 in French and which claims the benefit of French patent application No. 0604269, filed May 12, 2006.

FIELD OF THE INVENTION

The present invention relates to a portable compact antenna, more particularly an antenna designed to receive television signals, notably the reception of digital signals on a portable electronic device such as a portable computer, a PDA (Personal Digital Assistant) or any other similar device requiring an antenna to receive electromagnetic signals.

BACKGROUND OF THE INVENTION

On the current accessories market, there are items of equipment that can receive signals for terrestrial digital television (TNT) directly on a laptop computer. The reception of terrestrial digital television signals on a laptop computer can benefit from the computation power of the said computer to decode a digital image, particularly for decoding a flow of digital images in MPEG2 or MPEG4 format. This equipment is most frequently marketed in the form of a unit with two interfaces, namely one RF (radiofrequency) radio interface for connection to an interior or exterior VHF-UHF antenna and a USB interface for the connection to the computer.

The devices currently on the market are generally constituted by a separate antenna such as a whip or loop type antenna mounted on a unit carrying a USB connector.

In the French patent no. 05 51009 submitted on 20 Apr. 2005, the applicant proposed a compact wideband antenna covering the entire UHF band, constituted by a dipole type antenna. This antenna is associated with an electronic card that can be connected to a portable device using for example, a USB type connector.

More specifically, the antenna described in the French patent application no. 05 51009, comprises a first and a second conductive arm supplied differentially, one of the arms, called first arm, forming at least one cover for an electronic card. More specifically, the first arm has the form of a box into which the electronic card, comprising the processing circuits of the signals received by the dipole type antenna, is inserted. These circuits are most often connected to a USB type connector enabling the connection to a laptop computer or any other similar device. The embodiments described in this patent application refer to fully conductive arms.

SUMMARY OF THE INVENTION

According to a first aspect of the present invention, said invention relates to a portable compact antenna formed from a first dipole type element operating in a first frequency band and comprising a first and at least one second conductive arm, differentially supplied, the first arm, referred to as cold arm, forming at least one cover for an electronic card, the second arm, referred to as hot arm, being constituted by a U shaped conductive element realized on an insulating substrate.

Moreover, the solution proposed in the French patent application above covers the entire UHF band. However, to be able to provide the widest possible commercial cover with a product of this type, it is important to be able to receive, in addition to the UHF band (470-862 MHz) at least the VHF-III band (174-225 . . . 230 MHz) in which some countries such as Germany or Italy continue to broadcast digital multiplexes.

According to a second aspect, the present invention thus relates to a portable compact antenna of the type described above capable of meeting this requirement.

The antenna in accordance with the invention is a portable compact antenna formed from a first dipole type element operating in a first frequency band and comprising a first and at least one second conductive arm, differentially supplied, the first arm, referred to as cold arm, forming at least one cover for an electronic card, the second arm, referred to as hot arm, is constituted by a U-shaped conductive element realized on an insulating substrate. To enable operation in a second frequency band, such as the VHF band, preferably VHF-III, the second arm comprises a second radiating element dimensioned to operate in a second frequency band, the second radiating element being realised on an insulating substrate between the branches of the U-shaped element.

According to an embodiment, the second element is constituted by a conductive element folded into bends, the length of the element being determined by $k*\lambda 2/2-L1$ where $\lambda 2$ is the wavelength at the central frequency of the second frequency band, K is a positive integer corresponding to a harmonic of the second frequency band and L1 is the length of the cold arm of the antenna.

Preferably, the conductive element is formed by a strip whose width is comprised between 0.2 mm and 2 mm and whose thickness is greater than the thickness of the skin of the conductive material, the thickness of the strip being greater than or equal to 20 μm.

To minimise the interactions between the first and second frequency bands, the spacing between the second radiating element and each branch of the U-shaped element is greater than or equal to 0.2 mm.

To improve the performance of the second radiating element, the spacing between the bends is greater than or equal to 0.2 mm, the bends can be parallel to the branches of the U-shaped element or perpendicular to said branches. In fact, the arrangement of the bends is optimised in such a way to maximise the radiation yield of the antenna in the first frequency band while interfering as little as possible with the operation of the antenna in the second frequency band.

According to one preferential embodiment of the present invention, the first frequency band is the UHF band and the second frequency band is the VHF band, preferably the VHF-III band.

Other characteristics and advantages of the invention will appear upon reading the description of different embodiments, this description being realized with reference to the enclosed drawings, wherein:

BRIEF DESCRIPTION OF THE DRAWINGS

To simplify the description, the same elements have the same references as the figures.

With reference to FIG. 1, a description will first be made of an embodiment of a dipole type antenna that can be used for receiving terrestrial digital television on a laptop computer or similar device, as described in the French patent application no. 05 51009 submitted in the name of the applicant.

DETAILED DESCRIPTION OF PREFERRED EMBODIMENTS

Figure 1:
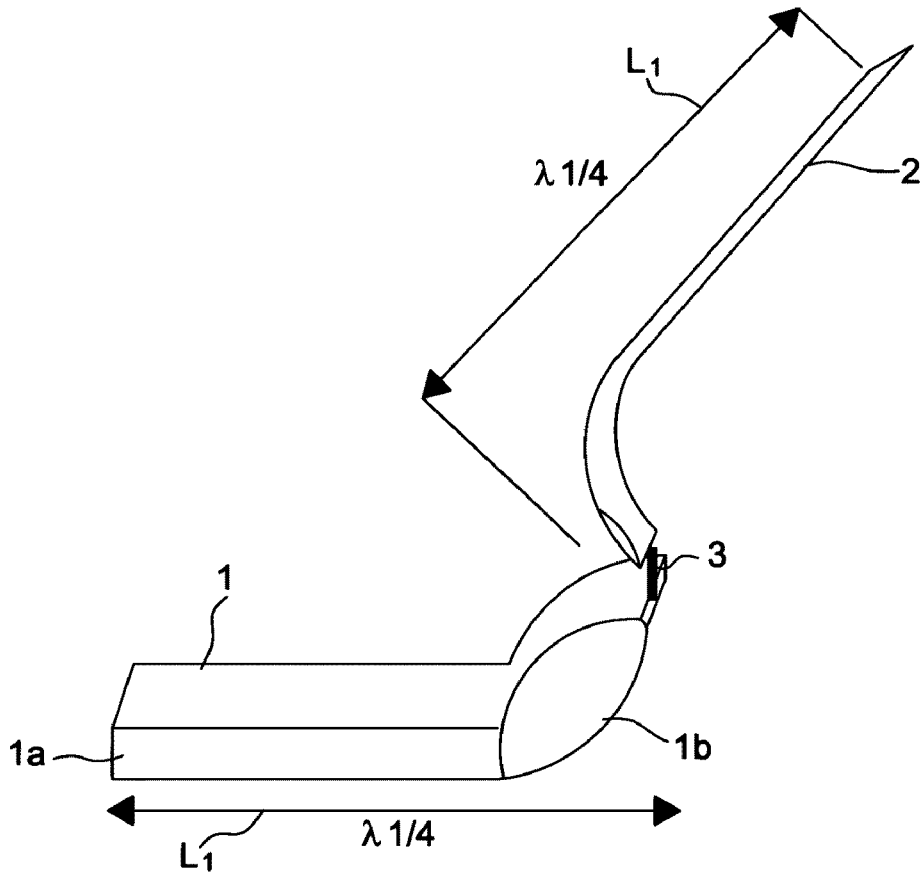
FIG. 1 is a diagrammatic perspective view of an antenna as described in the French patent no. 05 51009 in the name of the applicant.

As shown in FIG. 1, this dipole type antenna comprises a first conductive arm 1 also known as cold arm and a second conductive arm 2 also known as hot arm, both arms being connected to each other by means of an articulation zone 3 located at one of the extremities of each of the arms.

More specifically, the arm 1 noticeably has the shape of a box notably being able to receive an electronic card for which an embodiment will be described subsequently. The box has a part 1*a* of a noticeably rectangular form, extending by a curved part 1*b* opening out gradually so that the energy is radiated gradually, which increases the impedance matching over a wider frequency band. The length L1 of the arm 1 is noticeably equal to $\lambda 1/4$ where $\lambda 1$ is the wavelength at the central operating frequency. Hence, the length L1 of arm 1 approaches 112 mm for an operation in the UHF band (frequency band between 470 and 862 MHz).

As shown in FIG. 1, the antenna comprises a second arm 2 mounted in rotation around the pin 3 which is also the point of connection of the antenna to the signal processing circuit, namely to the electronic card not shown inserted into the box formed by the arm 1. The electrical connection of the antenna is made by a metal strand, for example a coaxial or similar cable, whereas the rotation pin is made of a material relatively transparent to electromagnetic waves.

As shown in FIG. 1, the arm 2 that can be articulated around the pin 3 has a length L1 noticeably equal to $\lambda 1/4$. The arm 2 also has a curved profile followed by a flat rectangular part enabling it to be folded back fully against the arm 1 in closed position. The arm 2 being mounted in rotation at 3 with respect to the arm 1, this enables the orientation of the arm 2 to be modified so as to optimise the reception of the television signal.

Figure 2:
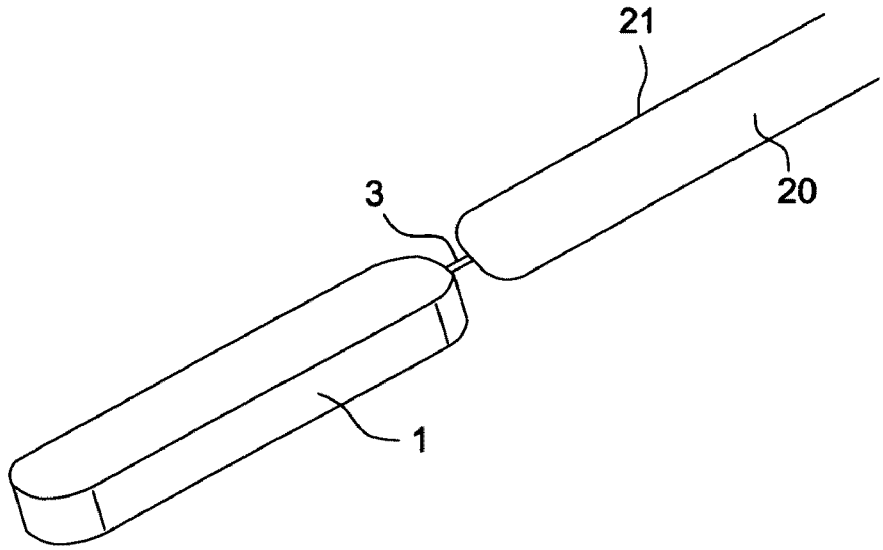
FIG. 2 is a diagrammatic perspective view of another embodiment of an antenna such as the view in FIG. 1 according to a first aspect of the present invention.

With reference to FIG. 2, another embodiment of a dipole type antenna as described in the French patent application no 05 51009, will now be described.

As shown in FIG. 1, the antenna comprises a first arm 1 called the cold arm having the form of a box and a second arm, called the hot arm, connected to arm 1 by an articulation 3. In this case, the hot arm is constituted by a U-shaped element 21 in a conductive material, realized on an insulating substrate 20. According to a non-restrictive embodiment, the substrate is comprised of a material known as "KAPTON" covered with a layer of copper that is etched to realize the U-shaped element.

As described above, the cold arm and the hot arm each have a length L1 noticeably equal to $\lambda 1/4$ where $\lambda 1$ represents the wavelength at the operating central frequency. Hence, each branch of the U 21 has a length that is noticeably equal to $\lambda 1/4$.

As clearly shown on FIG. 2, the U-shaped element is linked at the level of the articulation 3, by an electric connection element such as a metal strand, to an electronic card not shown, inserted into the box formed by the cold arm 1. Hence the antenna of FIG. 2 is dimensioned to operate in the UHF band.

To ensure the widest possible commercial coverage, it is interesting that an antenna of the type described with reference to FIG. 2 can receive the VHF frequency band, in addition to the UHF frequency band, more particularly the VHF-III frequency band (174-225 . . . 230 MHz) in which some countries such as Germany or Italy continue to broadcast digital multiplexes.

Thus, on FIGS. 3 and 4, a first embodiment was shown with an antenna in accordance with the present invention, being able to function both within the UHF and VHF band, as will be explained in more detail hereafter.

Figure 3:
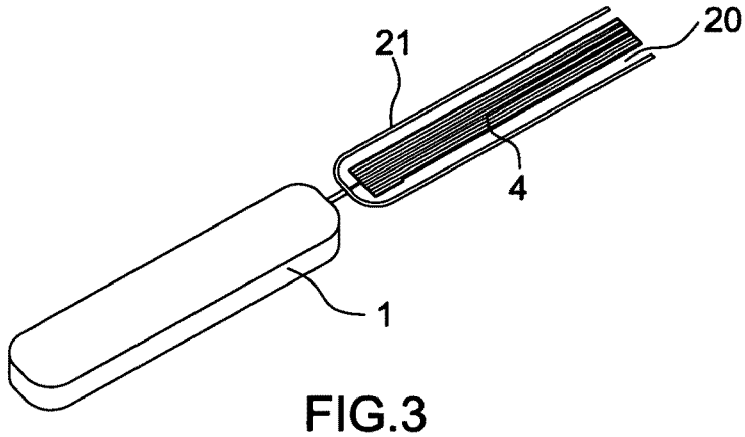
FIG. 3 is a diagrammatic perspective view of a first embodiment of an antenna in accordance with the present invention and operating in the UHF and VHF bands.

As shown in FIG. 3, the antenna in accordance with the present invention comprises a first arm 1 or cold arm with, like the arm 1 of the antenna of FIG. 2, the form of a box being able to receive an electronic card. Arm 1 is extended by a second arm also called the hot arm, connected in rotation to arm 1 by means of a pin 3.

This hot arm is realized like the hot arm of the antenna shown in FIG. 2. It comprises, on an insulating substrate 20, a metallization 21 in U-shaped form. Moreover, the connection to the signal processing circuit, and more particularly to the electronic card inserted in arm 1, is realized at the level of the pin 3.

In accordance with the second aspect of the present invention and as represented in FIG. 2, on the substrate 20, a second radiating element 4 is realized, dimensioned to operate in a second frequency band, more notably in the VHF band. This second radiating element is realized in the form of a metallized element on the insulating substrate between the branches of the U-shaped element.

Figure 4:
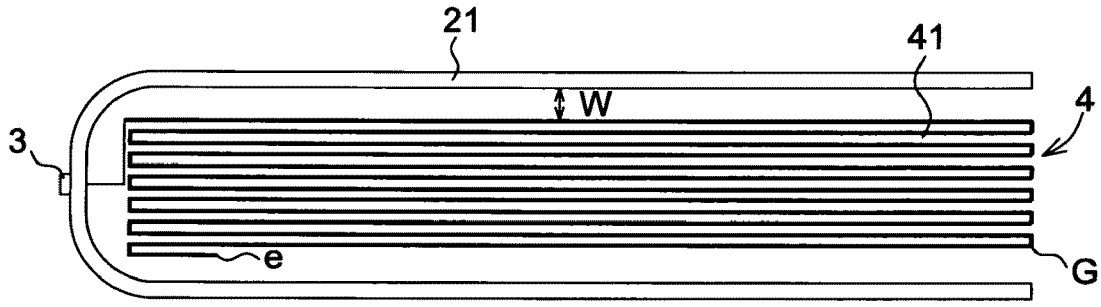
FIG. 4 is a plan view from above of the hot arm of the antenna of FIG. 3.

As shown in more detail in FIG. 4, the element 4 is constituted by a conductive element 41 folded into bends. The total length of the conductive element 41 is determined by the value $k*\lambda 2/2-L1$ where $\lambda 2$ is the wavelength at the central frequency of the second band of frequencies, namely the VHF band in the embodiment shown, k is a positive integer representing a harmonic of the second frequency band and L1 is the length of the arm 1.

According to an embodiment of the present invention, the various elements forming the arm 2 are obtained by etching on a "KAPTON" substrate covered with a layer of copper having a thickness greater than the thickness of the skin of conductive material, the U-shaped element 21 and the conductive element or strip 41 form bends, with a width W between the U-shaped element 21 and the conductive strip 41 in bends greater than or equal to a critical width of 0.2 mm, as will be explained subsequently.

The U-shaped element 21 has a width of around 2 mm whereas the conductive element 41 in bends has width I between 0.2 mm and 2 mm, with a spacing between two bends greater than or equal to 0.2 mm.

In fact, the length of the conductive element in the form of bends is chosen to obtain a resonant frequency close to the upper frequency of the VHF band, more particularly the VHF-III band. It is chosen to resonate either on the first harmonic of this frequency or on the upper harmonics according to the implementation space possible. The arrangement of the bends, namely their form and width, is optimised so as to maximise the radiation yield of the antenna in the VHF band while interfering as little as possible with the operation of the antenna in the UHF band.

The results of a simulation realized on an antenna as shown in FIGS. 3 and 4 will now be given, with the following dimensions for the hot arm of the antenna, namely:

The spacing g between 2 bends=0.25 mm

The width I of the conductive element or strip 41 is comprised between 0.2 mm and 0.83 mm.

The thickness of the strip is greater than or equal to 20 μm.

The width W between the radiating element 4 and the branches 21 of the U-shaped element is in the order of 4.5 mm.

The width of the branches 21 of the U-shaped element is equal to 1.54 mm.

Figure 5:
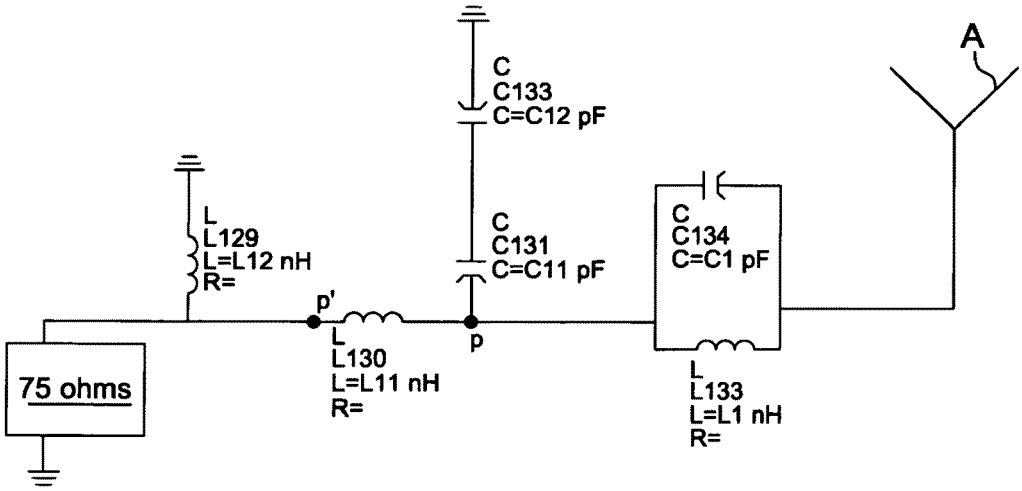
FIG. 5 is a diagrammatic view of an impedance matching circuit at the antenna output.

The simulation was carried out by connecting an antenna as shown in FIGS. 3 and 4 on a load impedance of 75 ohms with an impedance matching circuit as shown in FIG. 5. This impedance matching circuit is therefore constituted between the antenna output A at the level of the pin 3 and the 75 ohms load by a parallel circuit constituted by a self-impedance L1 of value 100 nH and capacitor of value 3.2 pF, followed by two capacitors C11 and C12 connected in series between the ground and a point of connexion p to the parallel circuit L1-C1. These two capacitors C11, C12 have a value of 1.2 pF. Between the point p and a point p', a self-impedance of value 38 nH is shown. A second self-impedance L12 of value 202 nH is shown between the point p' and the ground, the point p' being connected to the load.

The response of the antenna connected to the impedance matching circuit described above was simulated using two different software applications, namely the IE3D Modua software and the ADS2004A software that is used, notably, to optimise the impedance matching network of the antenna.

Figure 6:
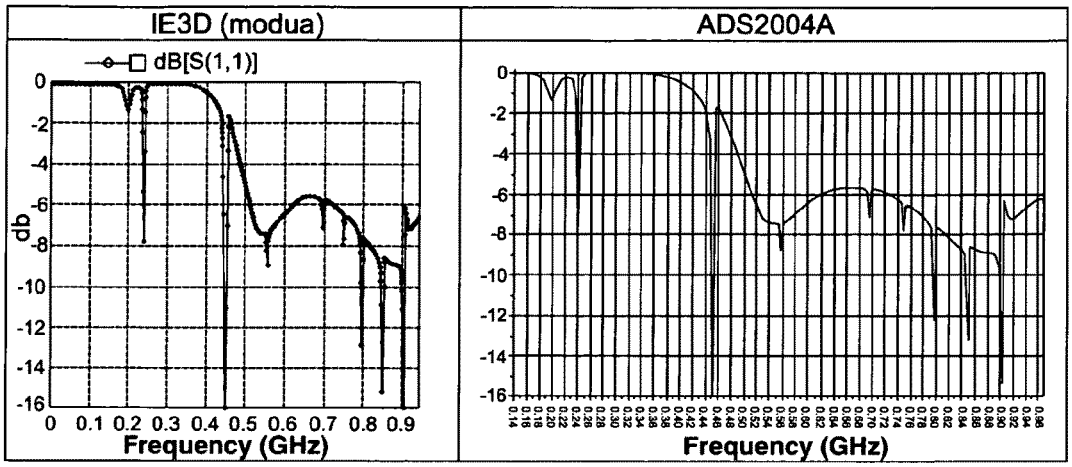
FIG. 6 shows the impedance matching curves of the antenna of FIGS. 3 and 4 obtained using two simulation software applications.

With these two software applications, the impedance matching curves S11 were obtained as a function of the frequency, shown in FIG. 6.

Hence, the results of FIG. 6 show that the impedance matching of the antenna is relatively good (−6 dB on average) over the entire UGF band with losses less than 1.5 dB.

Figure 7:
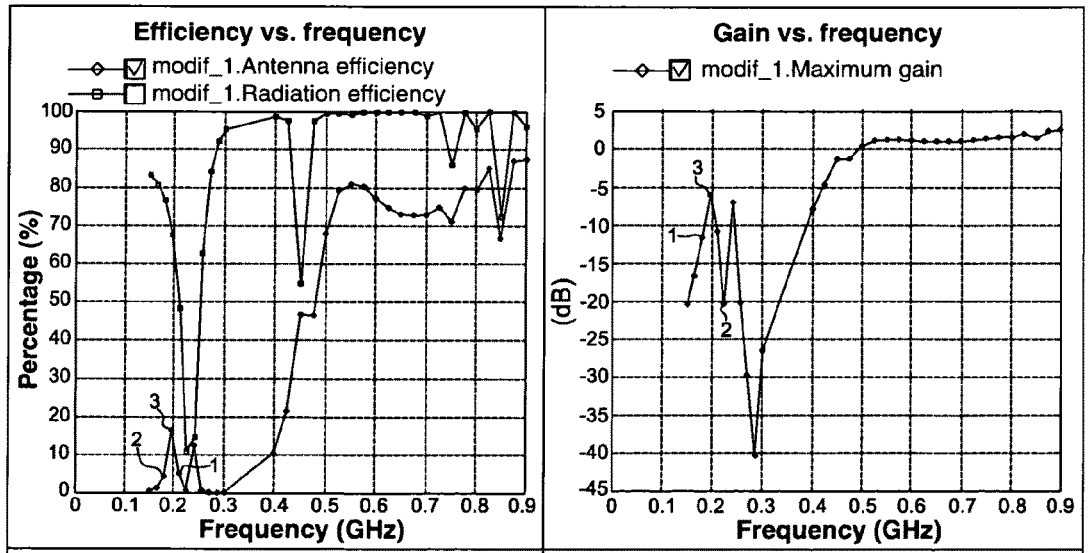
FIG. 7 shows the efficiency and gain curves obtained by simulating an antenna in accordance with FIGS. 3 and 4.

Moreover, FIG. 7 shows the curves giving the efficiency of the antenna and the gain as a function of the frequency of the antenna of the FIG. 4.

Consequently, with the performances obtained for impedance matching, the efficiency respectively the gain of the antenna with its impedance matching is at a maximum of 15%/−5 dBi for the VHF part and at least 50%/−1 dBi for the UHF part. Good performances are therefore obtained considering the size of the assembly.

Figure 8:
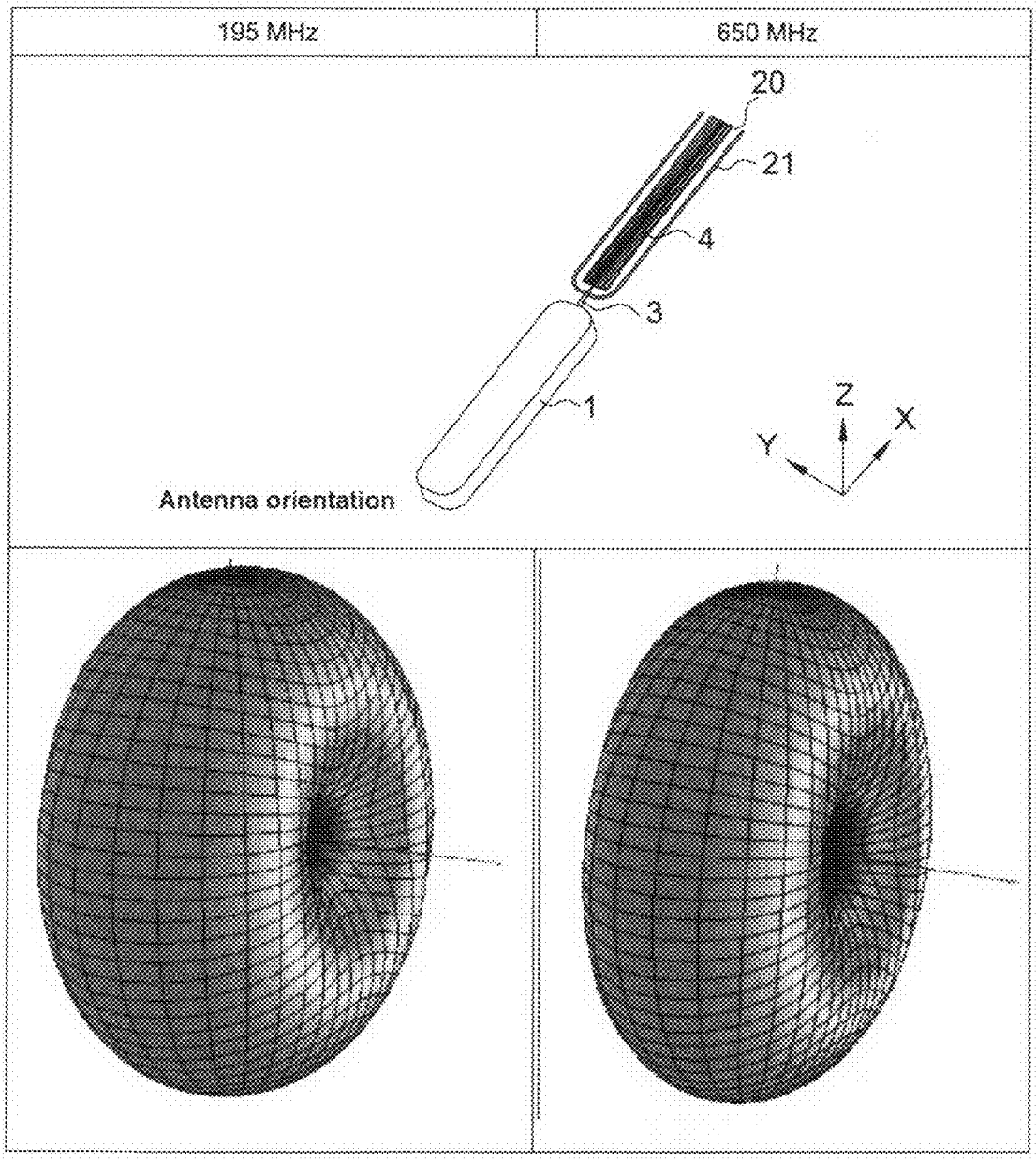
FIG. 8 shows the radiation patterns respectively in the UHF and VHF bands, obtained by simulating an antenna in accordance with FIGS. 3 and 4.

FIG. 8 shows the radiation patterns respectively in the UHF band and in the VHF band of the antenna of FIGS. 3 and 4. It is seen according to the patterns obtained that, for the central frequencies of the UHF (650 MHz) and VHF (195 MHz) bands, the radiation patterns are quasi-omnidirectional and confirm an operation of the antenna in these two bands.

The first embodiment described above was realized with a relatively large distance between the second radiating element 4 and the branches of the U forming the hot arm of the dipole. A study was conducted to determine the conditioned required to implement to reduce the possible interaction between the UHF band and the VHF band, in particular in the lower part of the UHF band.

Figure 9:
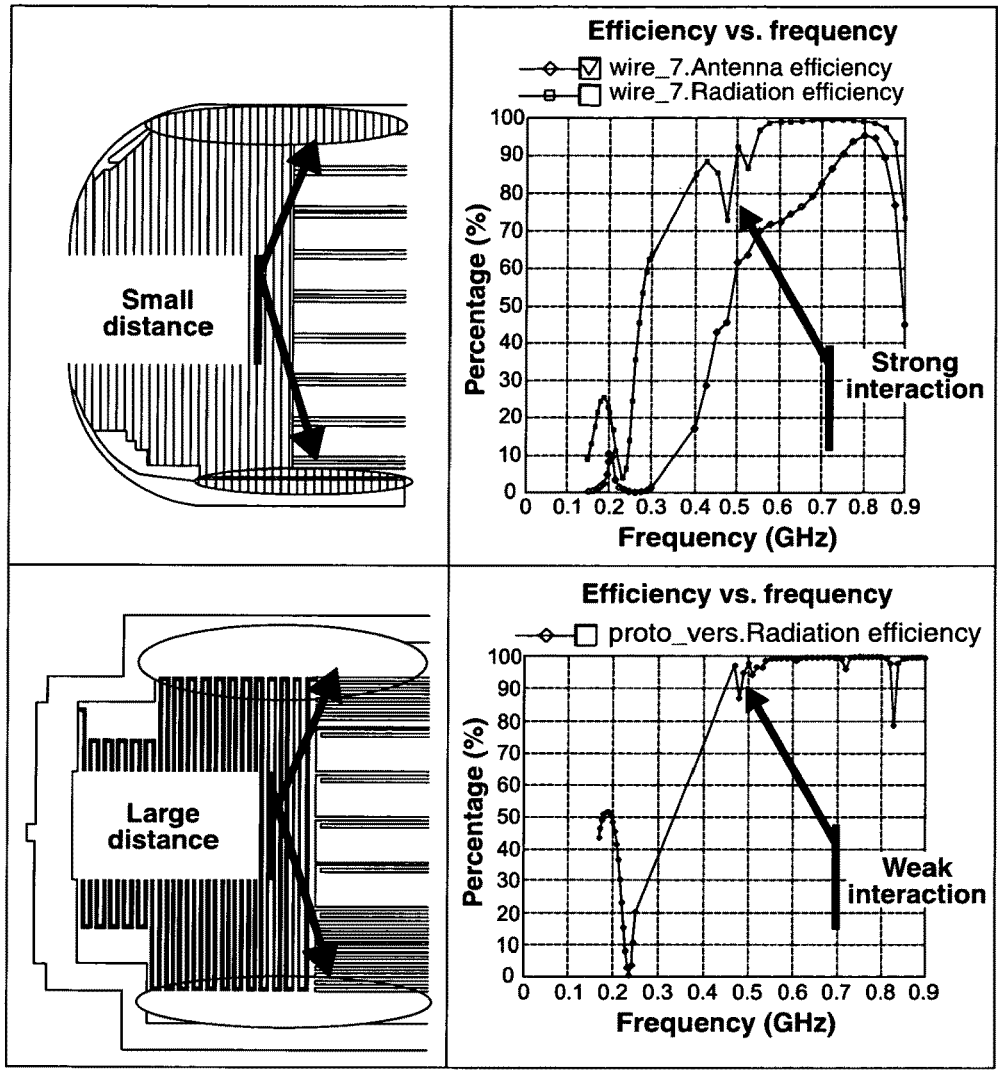
FIG. 9 diagrammatically shows two embodiment variants of the hot arm with the corresponding efficiency curves.

As shown in the upper part of FIG. 9, when the distance between the branches of the element of the hot arm U and the second radiating element is low, a strong interaction is observed, which is shown by the efficiency curve of the frequency associated with this figure. On the contrary, when the distance between the second element and the branches of the element in U of the hot arm is greater, a weak interaction is observed, as shown by the efficiency curve as a function of the frequency associated with this figure. The optimisation of the distance between the branches of the U-shaped element in bends must take into account the technological constraints of production and the necessity of inserting the second element between the branches of the U-shaped element.

Figure 10:
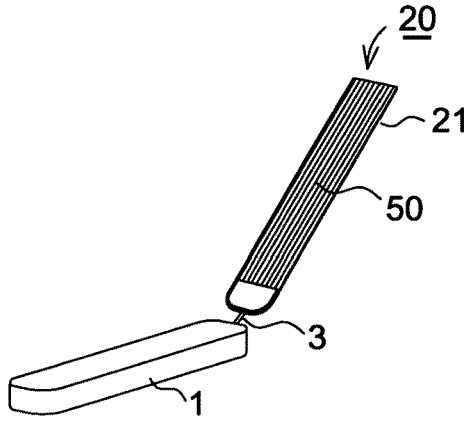
FIG. 10 is a diagrammatic perspective view of a second embodiment of an antenna in accordance with the present invention and operating in the UHF and VHF bands.

A description will now be given, with reference to FIGS. 10 and 11, of a second embodiment of an antenna in accordance with the present invention. As shown in FIG. 10, this antenna comprises a first arm or cold arm 1 identical to the cold arm of the embodiment of FIGS. 2 and 3. This first arm is articulated at the level of a pin 3 with a second arm 20 or hot arm comprising on an insulating substrate, a first radiating U-shaped element 21 to obtain an operation in the UHF band and a second radiating element 50 realized between the branches 21 of the U-shaped element and dimensioned to operate in the VHF band.

Figure 11:
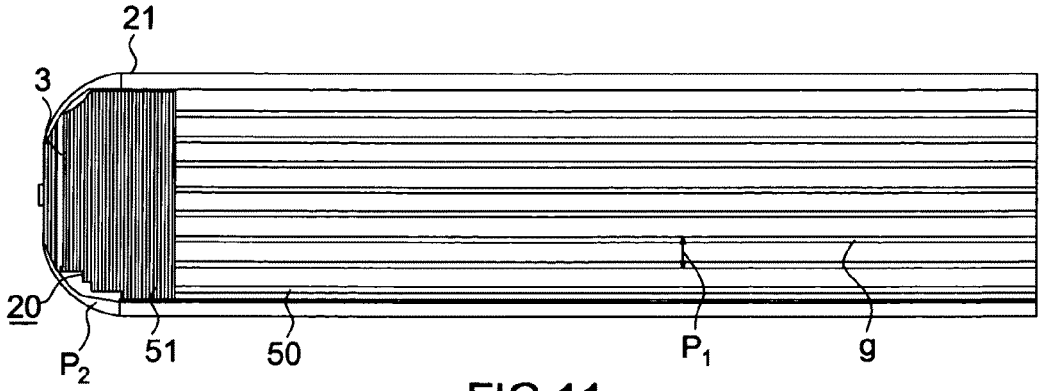
FIG. 11 is a plan view from above of the hot arm of the antenna of FIG. 10.

As shown in a more specific manner in FIG. 11, the second radiating element is constituted by a conductive element folded into bends comprising a part 50 formed by bends parallel to the branches 21 of the U-shaped element and extending to the connection at the level of the pin 3 by the bends 51 perpendicular to the branches of the U-shaped element 21. In this case, the bends 50 have a width of 2 mm and a spacing between bends equal to 0.2 mm whereas the bends 51 have a width of 0.2 mm and a spacing between bends of 0.2 mm. In this case, the total length of the bends is chosen to meet the equation $k*\lambda 2/2-L1$ with L1 the length of the first arm, λ2 the wavelength at the operating frequency in the second frequency band and k chosen to operate, for example, on the harmonic 2 for the resonance of the bends. The value k can be modified.

In fact, it is possible to modify the shape of the bends if the following design rules are followed:

For the UHF part, the length of the branches of the U and the length of the cold arm 1 are in the order of λ1/4 at the central frequency of the UHF band (666 MHz).

For the VHF part, the total length of the branches plus the length L1 of the cold arm 1 is in the order of λ2 at 230 MHz (for an operation on the harmony 2). The minimum widths and spaces are related to the technological choice of the realisation. In the case of a flexible substrate such as KAPTON, for the bends parallel to the branches of the U-shaped element, namely the longitudinal bends, the width chosen is in the order of 0.83 mm and the lo space between the bends is in the order of 250 μm.

Figure 12:
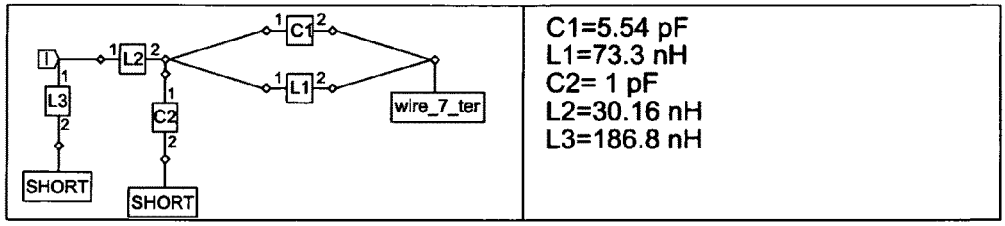
FIG. 12 is a diagrammatic view of an impedance matching circuit used with the antenna of FIG. 10.
Figure 13:
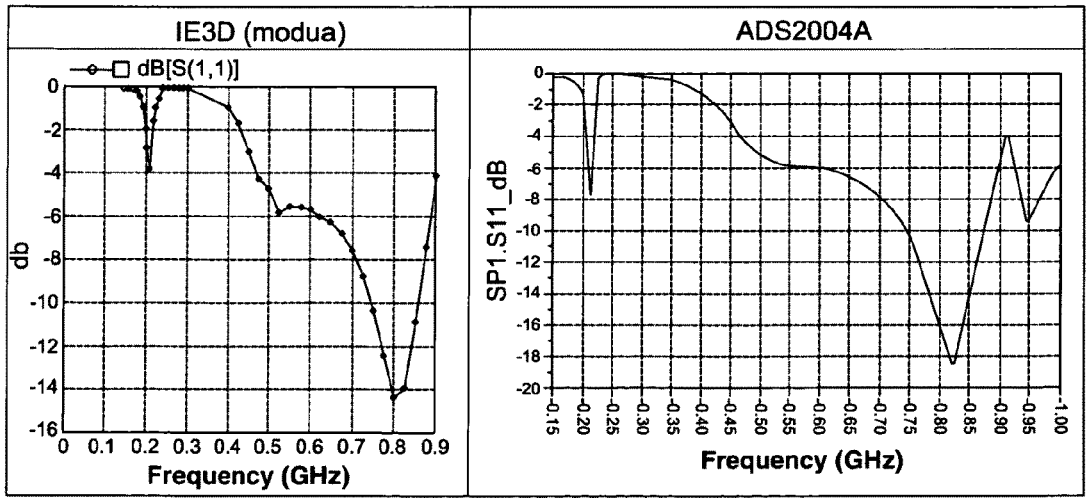
FIG. 13 shows the impedance matching curves of the antenna of FIGS. 10 and 11 simulated using two simulation software applications.

The results obtained by simulating an antenna such as shown in FIGS. 10 and 11 will now be given. The simulation was realized by connecting the antenna via an impedance matching circuit such as represented in FIG. 12 on a load impedance of 75 ohms. The impedance matching circuit shown in FIG. 12 is therefore diagrammatically constituted by a capacitor C1 of 5.54 pF and a self-impedance L1 of 73.3 nH mounted in parallel, a capacitor C2 mounted between the entry point 2 of the parallel LC circuit and a ground, said capacitor C2 having a value of 1 pF and a self-impedance L2 mounted in series between the point 2 and the entry point 1 of the antenna, this self-impedance L2 having a value of 30.7 nH and a self-impedance L3 mounted between the entry point 1 of the antenna and the ground, said self-impedance L3 having a value of 186.8 nH. With the circuit as described above, the simulation obtained using two different software applications IE3D MODUA and ADS 2004A gives the impedance matching curves as a function of frequency shown in FIG. 13. In FIG. 13, it is seen that the impedance matching of the antenna is relatively good (−6 dB on average) over the entire UHF band with losses less than 1.5 dB.

Figure 14:
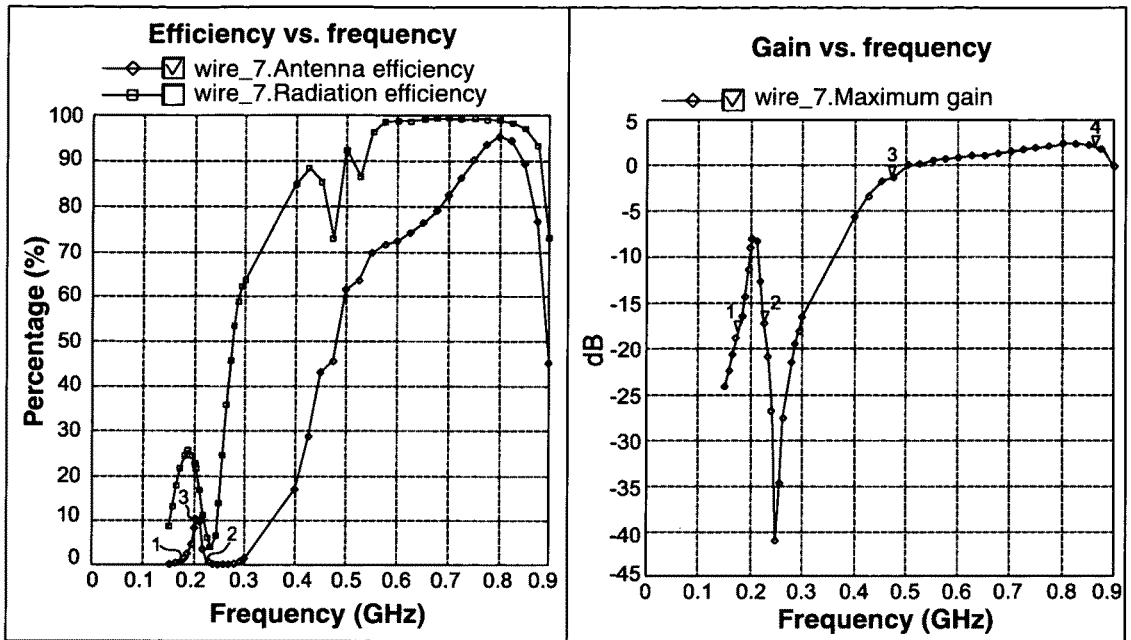
FIG. 14 shows the efficiency and gain curves obtained by simulating an antenna in accordance with FIGS. 10 and 11.

Likewise, FIG. 14 shows the efficiency curves as a function of the frequency and gain as a function of the frequencies obtained by simulation of the antenna of FIGS. 10 and 11.

Consequently, with the performances obtained for impedance matching, the efficiency respectively the gain of the antenna with its impedance matching is at a maximum of 10%/−7 dBi for the VHF part and at least 50%/−1.5 dBi for the UHF part. Good performances are therefore obtained considering the size of the assembly.

Figure 15:
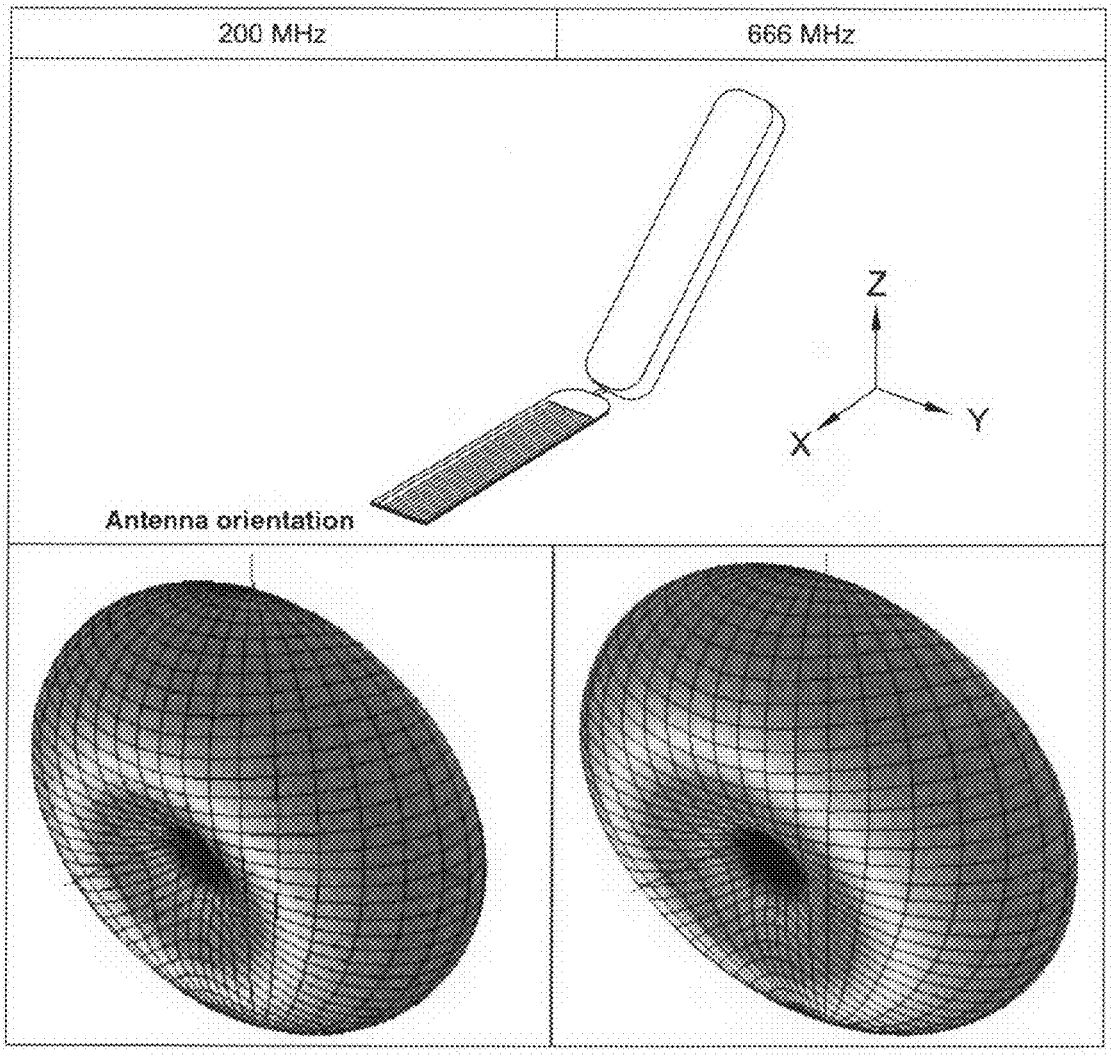
FIG. 15 shows the radiation patterns respectively in the UHF and VHF bands, obtained by simulating an antenna in accordance with FIGS. 10 and 11.

Moreover, FIG. 15 shows the radiation patterns obtained with the antenna of FIGS. 10 and 11 respectively in the UHF band at 666 MHz and in the VHF band at 200 MHz. Standard radiation patterns are therefore obtained, compliant with those of a dipole for the central frequencies of the UHF and VHF bands.

Figure 16:
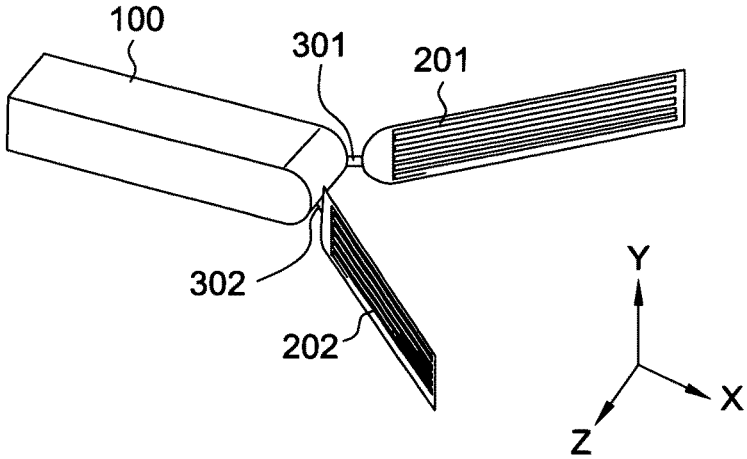
FIG. 16 shows a diversity antenna for which the hot arms can be realised in accordance with the present invention.

With reference to FIG. 16, a brief description will be made of the application of the present invention to a diversity antenna. In this case, the cold arm 100 is realized in an identical manner to the cold arm of FIGS. 2, 3 and 10. The present invention comprises at least two hot arms 201 and 202 respectively linked by articulation pins 301 and 302 to the cold arm 100. Both pins 301 and 302 are located at each extremity of the cold arm 100. Both hot arms 201 and 202 can be realized as the hot arms shown in FIGS. 4 and 11. This type of antenna can obtain diversity by reducing the reception losses due to the fading of the signal, notably in the case of the reception of terrestrial digital television or TNT.

Figure 17:
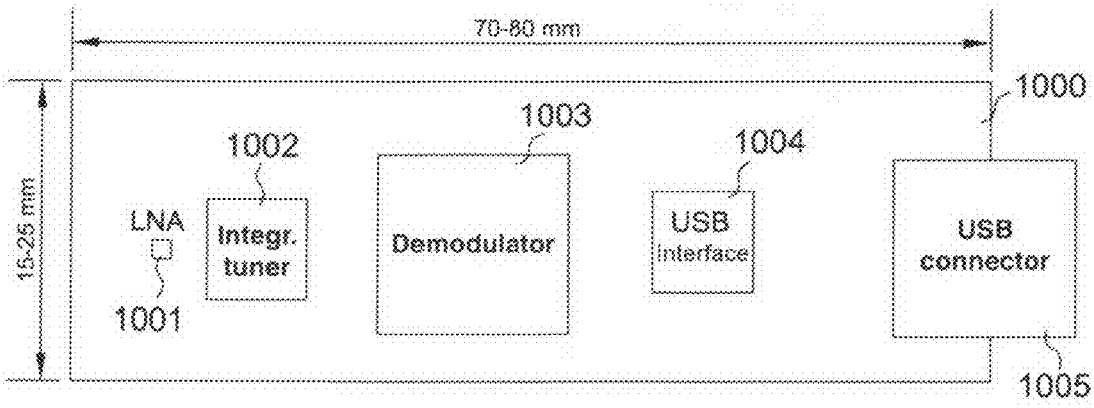
FIG. 17 is a diagrammatic representation of an electronic card used with the antennas in accordance with the present invention.

Moreover, with reference to FIG. 17, a description will be made of an example of electronic card that can be used with an antenna in accordance with the present invention. This electronic card is designed to be inserted into the box containing the cold arm as cover or as a box element. Hence, the card has a length of between 70-80 mm and a width of between 15-25 mm. This electronic card 1000 comprises a low noise amplifier LNA 1001 to which is connected the coaxial cable of the antenna at the level of the articulation 3. The LNA 1001 is linked to an integrated tuner 1002 processing both the VHF band and the UHF band. The tuner 1002 is connected to a demodulator 1003 the output of which is connected to a USB interface 1004, itself connected to a USB connector 1005. It is therefore possible with this system to connect the antenna to the USB input of a laptop computer or any other display element, which particularly enables terrestrial digital television to be received on a computer, PDA or any other portable device.

It is obvious to those in the skilled art that the embodiments described above are given as an example and can be modified, notably with regard to the shape and arrangement of the bends that must simply meet the criteria of length, width and spacing given above.

The invention claimed is:

1. A portable compact antenna formed from a dipole type element operating in a first frequency band and comprising a first conductive arm and at least one second arm, said first and second arms being interconnected at a level of a feed point to be differentially supplied, said second arm being constituted by a U-shaped conductive element, realized on an insulating substrate, said U-shaped conductive element comprising two branches linked together at the level of said feed point, wherein the second arm includes a second radiating element dimensioned to operate in a second frequency band, and constituted by a conductive element realised on the insulating substrate between the two branches of the U-shaped element, the length of the conductive element being determined by $k*\lambda 2/2-L1$ where $\lambda 2$ is the wavelength at the central frequency of the second frequency band, k is a positive integer corresponding to a harmonic of the second frequency band and L1 is the length of the first arm.

2. The antenna according to claim 1, wherein each branch of the U-shaped conductive element has a length determined by $\lambda/4$ where $\lambda$ is the wavelength at the central frequency of the first frequency band.

3. The antenna according to claim 1, wherein the second radiating element and each branch of the U-shaped element are spaced with a dimension greater than or equal to 0.2 mm.

4. The antenna according to claim 1, wherein the conductive element is folded into bends.

5. The antenna according to claim 4, wherein the conductive element is formed by a strip whose width is comprised between 0.2 mm and 2 mm and is realized in a conductive material so that the thickness of the strip is greater than the thickness of the skin of the conductive material.

6. The antenna according to claim 5, wherein the thickness of the strip is greater than or equal to 20 μm.

7. The antenna according to claim 4, wherein the bends are spaced with a dimension greater than or equal to 0.2 mm.

8. The antenna according to claim 4, wherein the bends are parallel to the branches of the U-shaped element.

9. The antenna according to claim 4, wherein the bends are perpendicular to the branches of the U-shaped element.

10. The antenna according to claim 4, wherein a first part of the bends is parallel to the branches of the U-shaped element and a second part of the bends is perpendicular to the branches of the U-shaped element.

* * * * *